United States Patent [19]

Wolber et al.

[11] 4,291,210

[45] Sep. 22, 1981

[54] SLIDE SWITCH

[75] Inventors: Robert Wolber, Lauterbach; Walter Obergfell, Schramberg, both of Fed. Rep. of Germany

[73] Assignee: Gebruder Junghans GmbH, Schramberg, Fed. Rep. of Germany

[21] Appl. No.: 68,591

[22] Filed: Aug. 22, 1979

[30] Foreign Application Priority Data

Sep. 12, 1978 [DE] Fed. Rep. of Germany ... 7827035[U]

[51] Int. Cl.[3] ..... H01H 1/36; H01H 15/00

[52] U.S. Cl. ..... 200/252; 200/254; 200/16 R

[58] Field of Search ..... 200/252, 254, 255, 257, 200/260, 292, 16 R, 16 A

[56] References Cited

U.S. PATENT DOCUMENTS 3,493,706 2/1970 Cherry et al. ..... 200/292

3,857,000 12/1974 Boulanger ..... 200/257

4,152,565 5/1979 Rose ..... 200/292

*Primary Examiner*—Willis Little

*Attorney, Agent, or Firm*—Burns, Doane, Swecker & Mathis

[57] ABSTRACT

An on-off slide switch is arranged on a circuit board, preferably that of a battery-operated electronic clock, for actuating a stepping motor thereof. The slide switch can be moved to different positions and interacts with several electric paths of the circuit board. The switch is arranged movably along one edge of the circuit board and bears against such edge via guide elements. The switch carries at least one contact element for shunting a plurality of tracks of the board and a grip for its manual operation. The slide switch, together with all elements carried by it is designed in the form of a punched-out, flexible metal part and is easily installed on or removed from the circuit board without the need for separate fasteners.

6 Claims, 7 Drawing Figures

SLIDE SWITCH

RELATED APPLICATIONS

The related disclosures of the following copending U.S. applications, filed simultaneously herewith, are incorporated herein by reference as if set forth at length:

1. U.S. application Ser. No. 68,590 by Robert Wolber et al. (corresponding to German Application No. G 78 27 030.1 filed Sept. 12, 1978).
2. U.S. application Ser. No. 68,620 by Robert Wolber et al. (corresponding to German Application No. G 78 27 031.2 filed Sept. 12, 1978).
3. U.S. application Ser. No. 68,619 by Hans Flaig et al. (corresponding to German Application No. P 28 39 611.4-34 filed Sept. 12, 1978)
4. U.S. application Ser. No. 68,598 by Roland Maurer (corresponding to German Application No. G 78 27 034.5 filed Sept. 12, 1978).
5. U.S. application Ser. No. 68,597 by Udo Schultheiss (corresponding to German Application No. G 78 27 033.4 filed Sept. 12, 1978).
6. U.S. application Ser. No. 68,595 by Friedrich Assmus (corresponding to German Application No. P 28 39 554.2-31 filed Sept. 12, 1978).
7. U.S. application Ser. No. 68,596 by Robert Wolber et al. (corresponding to German Application No. P 28 39 555.3-31 filed Sept. 12, 1978).

BACKGROUND AND OBJECTS OF THE INVENTION

The novel arrangement concerns a slide switch for turning an electrical instrument on or off. Slide switches which are movably mounted on circuit boards are known, per se. It is usually their function to cut off an alarm, and such switches are mounted within a groove of the circuit board, see for example published German patent application No. 20,10,424.

It is the object of the present invention to provide such a slide switch which can be mounted on and removed from the circuit board in a simple manner and without the need of special mounting elements on the circuit board.

BRIEF SUMMARY OF THE INVENTION

This object is achieved by providing a switch which is mounted to slide along an edge of the circuit board. The switch includes a guide element which engages one surface of the board, a contact element which opens or closes the circuit, and a manual gripping member. The novel arrangement of the slide switch at the outer edge of the circuit board makes the installation of the switch an extremely simple operation, namely by merely inserting it. Furthermore, the switch is self-retaining; there is no need to provide special fasteners or any slots on the circuit board.

THE DRAWING

A preferred embodiment of the novel slide switch will now be described in detail with reference to the drawing wherein.

DETAILED DESCRIPTION OF A PREFERRED EMBODIMENT OF THE INVENTION

Figure 1:
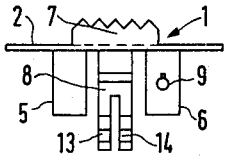
FIG. 1 is a front view of the slide switch.
Figure 2:
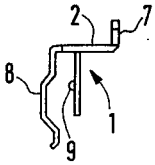
FIG. 2 is a side view of the slide switch.
Figure 3:
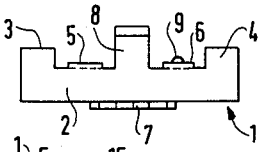
FIG. 3 is a plan view of the slide switch.

A novel slide switch 1, illustrated in the figures, includes a flat guide bar 2 onto which are formed two laterally projecting guide elements 3 and 4 (see FIG. 3), two other guide elements 5 and 6 which depend downwardly from the bar 2, an upwardly extending grip 7 and a contact element 8 which depends downwardly from the bar 2. The guide element 6 carries a protruding nipple 9 for locking the slide switch in position and which can engage for this purpose either one of two bores 10 or 11 which are located in a circuit board 12 (see FIGS. 4 and 5). The contact element 8 includes a longitudinal slot and two springy contact fingers 13 and 14 (see FIG. 1).

The slide switch is designed in the form of a punched-out, flexible metal part but could also be manufactured from synthetic material, with the metallic contact element 8 embedded therein.

Figure 4:
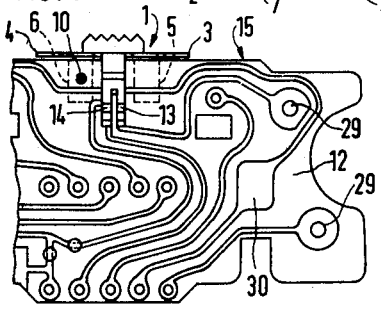
FIG. 4 shows the slide switch, mounted on the circuit board, in a circuit-closed position.
Figure 5:
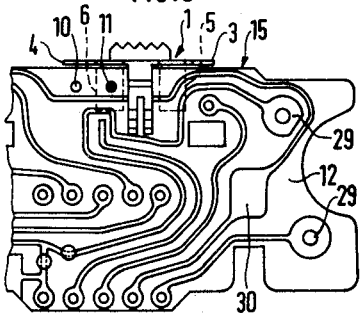
FIG. 5 shows the slide switch, mounted on the circuit board, in a circuit-open position.
Figure 6:
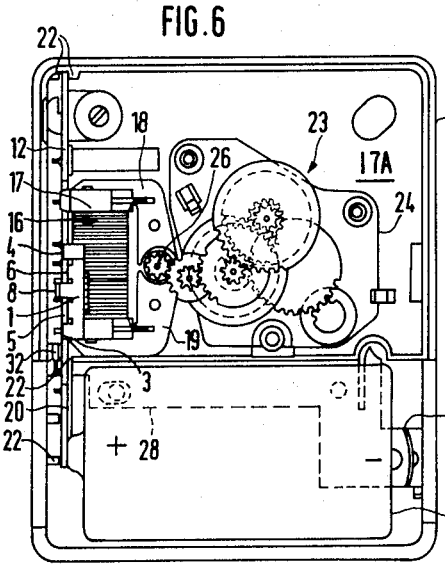
FIG. 6 is a view of a clock whose rear housing section is removed, depicting an inserted circuit board with the slide switch.

The slide switch 1 is arranged at one narrow side of the circuit board 12 and is movable along one edge 15 of this board as shown in FIGS. 4 to 6. The slide switch rests with its two guide elements 3 and 4 on the edge 15 and is supported by its two other guide elements 5 and 6 at the nonprinted side of the circuit board 12. The two contact fingers 13 and 14 of the contact element 8 engage the printed side of the circuit board 12. The two springy contact fingers are deflected by the board, resulting in a sufficiently strong pressure in the direction of the circuit board to keep the slide switch in its position by mechanical friction force.

Figure 7:
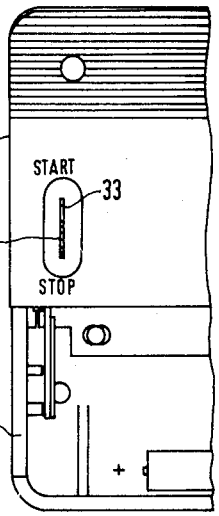
FIG. 7 is a partial view of the clock including the rear section of the housing.

The slide switch functions to close or open an electric circuit, such as to stop or start a stepping motor 16 of a battery-operated clock 17 (see FIGS. 6 and 7). The static components of the stepping motor 16, namely a coil 17A and two stacks of stator laminations 18, 19 as well as the elements of the electronic circuitry controlling the stepping motor, namely a quartz resonator, an integrated circuit and several capacitors, together with a positive contact plate 20 are also arranged on the circuit board 12, as explained in greater detail in the previously mentioned application of Wolber, Maurer, and Jesse entitled "Methods and Apparatus for Assembling an Electrical Instrument." As explained therein in greater detail, the circuit board 12, together with the above-listed, externally premounted components, can be inserted into the front section 21 of the casing where it is retained by appropriately designed guide ribs 22. The lock also contains a clockwork 23, its parts mounted at appropriately designed bearing points within the area between the bottom of the front section 21 of the casing, and a dividing plate 24 disposed within the area between this plate and the bottom of the rear section 25 of the casing (see FIG. 7). The first wheel of this clockwork is engaged by a pinion which is attached to the rotor 26 of the stepping motor 16. The clock is supplied with current by a battery 27. The battery is connected with the proper paths 29, 30 of the board by way of the positive contact plate 20 and a negative contact spring 28, which is fastened within the front section 21 of the casing.

One springy contact finger 31 of the negative contact spring 28 adjoins the negative terminal of the battery 27, and another contact finger 32, shaped in the form of a knife-edge contact, bears under pressure against a track 30 of the circuit board 12, thus holding the latter in its installed position.

FIG. 4 shows the slide switch 1 in its functional position where the two contact fingers 13 and 14 of the contact element 8 are touching two tracks of the board, thereby shunting the same so that the pulse feed from the integrated circuit to the stepping motor is interrupted.

FIG. 5 shows the slide switch in its non-functional position, a position where the two contact fingers of the slide contact element do not touch the two above-mentioned tracks so that the stepping motor will receive successive pulses from the integrated circuit.

The slide switch can be set by its grip which protrudes, as shown in FIG. 7, through a slot 33 of a rear section 25 of the casing so that it can be operated manually. The labels "start" and "stop" on the rear section 25 of the casing denote the functional and non-functional positions of the slide switch.

It will be appreciated that the slide switch 1 is inexpensive to make and can be easily installed onto the circuit board to facilitate assembly of the instrument and can be easily removed therefrom for repair, without the need for separate fasteners.

Although the invention has been described in connection with a preferred embodiment thereof, it will be appreciated by those skilled in the art that additions, substitutions, modifications, and deletions not specifically described may be made without departing from the spirit and scope of the invention as defined in the appended claims.

What is claimed is:

1. A slide switch in combination with a circuit board of the type which is generally planar having opposed surfaces and a peripheral edge extending between said surfaces, one of said surfaces including electrical conductor tracks, said switch comprising:

a guide bar disposed in facing relationship with said edge and carrying a hand-manipulable grip projecting away from said edge to enable said guide bar to be slid relative to said edge between a plurality of positions, and guide means extending from opposite sides of said guide bar in stradling relationship with said circuit board, and in resilient gripping engagement therewith to frictionally mount said switch on said circuit board, said guide means including:

a contact element extending from one side of said guide bar and across said one surface of said circuit board, said contact element including contact fingers which resiliently engage and electrically interconnect respective ones of said conductive tracks when said guide bar is in one of said positions, and a pair of guide elements extending from the opposite side of said guide bar and across the other surface of said circuit board in resilient engagement with said other surface with a force directed opposite to that of said contact fingers.

2. Apparatus according to claim 1 wherein said guide bar, guide elements, contact element, and grip comprise a one-piece, punched-out metal component.

3. Apparatus according to claim 1, wherein said guide bar, and guide elements are injection molded of synthetic material, said contact element formed of metal and embedded within said synthetic material.

4. A slide switch according to claim 1, wherein both ends of said guide bar extend parallel to said edge beyond said guide means to form guide portions which contact said edge.

5. A slide switch according to claim 1, wherein one of said guide elements includes a nipple projecting toward said circuit board, said circuit board including at least one recess for releasably receiving said nipple in a manner tending to retain said nipple therein at one of said positions of said guide bar.

6. A slide switch according to claim 1, further in combination with a clock of the type having a housing with front, rear, and side walls, a gear mechanism inserted into said housing perpendicularly to said front wall, said rear wall being insertable onto said housing and having a slot, said circuit being inserted edge-wise into said housing in the same direction as said gear mechanism so as to lie substantially parallel to said side walls, said switch being oriented so as to project through said slot upon installation of said rear wall.

* * * * *